US008036556B2

(12) United States Patent
Kinouchi et al.

(10) Patent No.: US 8,036,556 B2
(45) Date of Patent: Oct. 11, 2011

(54) FIXING DEVICE HAVING AN ELECTRIC POWER CONTROL SYSTEM TO AN INDUCTION HEATING COIL FOR IMAGE FORMING APPARATUS

(75) Inventors: Satoshi Kinouchi, Shinjuku-ku (JP); Osamu Takagi, Chofu (JP); Yoshinori Tsueda, Fuji (JP); Tetsuo Kitamura, Mishima (JP); Hiroshi Nakayama, Mishima (JP); Yohei Doi, Mishima (JP); Kazuhiko Kikuchi, Yokohama (JP); Masanori Takai, Izunokuni (JP); Toyoyasu Kusaka, Izu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 543 days.

(21) Appl. No.: 11/942,079

(22) Filed: Nov. 19, 2007

(65) Prior Publication Data

US 2008/0118265 A1 May 22, 2008

Related U.S. Application Data

(60) Provisional application No. 60/866,660, filed on Nov. 21, 2006.

(30) Foreign Application Priority Data

Oct. 1, 2007 (JP) ..... 2007-257743

(51) Int. Cl.
*G03G 15/20* (2006.01)

(52) U.S. Cl. ..... 399/69

(58) Field of Classification Search ..... 399/67, 399/69, 70

See application file for complete search history.

(56) References Cited

U.S. PATENT DOCUMENTS

| | | | | |
|---|---|---|---|---|
| 7,139,495 | B2 | 11/2006 | Morihara et al. | |
| 7,203,439 | B2 | 4/2007 | Sone et al. | |
| 7,242,880 | B2 | 7/2007 | Sone et al. | |
| 2004/0037580 | A1 * | 2/2004 | Ohta | 399/69 |
| 2007/0217836 | A1 | 9/2007 | Sone et al. | |
| 2007/0246457 | A1 | 10/2007 | Tsueda et al. | |
| 2008/0118260 | A1 | 5/2008 | Doi et al. | |
| 2008/0118262 | A1 | 5/2008 | Kinouchi et al. | |
| 2008/0118263 | A1 | 5/2008 | Nakayama et al. | |
| 2008/0118266 | A1 | 5/2008 | Nakayama et al. | |
| 2008/0237223 | A1 | 10/2008 | Kinouchi et al. | |

FOREIGN PATENT DOCUMENTS

| | | |
|---|---|---|
| JP | 09-197856 | 7/1997 |

* cited by examiner

*Primary Examiner* — David M Gray
*Assistant Examiner* — Joseph S Wong
(74) *Attorney, Agent, or Firm* — Turocy & Watson, LLP

(57) ABSTRACT

A fixing apparatus according to an embodiment of the present invention controls, using a CPU and a temperature comparator, an inverter circuit that supplies electric power to an induction heating coil and performs temperature control for a heat roller. The CPU adjusts and controls a power value supplied by the inverter circuit. When the adjustment and control of the power value by the CPU is late, the inverter circuit is ON-OFF controlled by the temperature comparator.

27 Claims, 8 Drawing Sheets

FIXING DEVICE HAVING AN ELECTRIC POWER CONTROL SYSTEM TO AN INDUCTION HEATING COIL FOR IMAGE FORMING APPARATUS

CROSS REFERENCE TO RELATED APPLICATION

This invention is based upon and claims the benefit of priority from prior U.S. Patent Application 60/866,660 filed on Nov. 21, 2006 and Japanese Patent Application 2007-257743 filed on Oct. 1, 2007 the entire contents of which are incorporated herein by reference.

BACKGROUND OF THE INVENTION

1. Field of the Invention

The present invention relates to a fixing apparatus mounted on image forming apparatuses such as a copying machine, a printer, and a facsimile, and, more particularly to a fixing apparatus for an image forming apparatus employing an induction heating system.

2. Description of the Background

In recent years, there are fixing apparatuses of an induction heating system used in image forming apparatuses of an electrophotographic system such as a copying machine and a printer. In the fixing apparatuses of the induction heating system, an eddy-current is generated in a metal layer of the fixing apparatus using an induction heating coil to cause the fixing apparatus to generate heat. In the past, there is a device that ON-OFF controls electric power supplied to the induction heating coil to keep the temperature of a fixing apparatus constant.

However, from a viewpoint of quick-start of the image forming apparatus or saving of energy consumption, a fixing apparatus having a small heat capacity may be used. In the case of such a fixing apparatus having a small heat capacity, temperature fluctuation in the fixing apparatus increases when the supply of the electric power to the induction heating coil is simply ON-OFF controlled. Therefore, it is likely that an adverse effect occurs in fixing performance. Thus, there is also a device that adjusts, to more finely control the electric power supplied to the induction heating coil, fluctuation in electric energy supplied to the induction heating coil to decrease a temperature ripple of the fixing apparatus using a CPU.

However, when the electric power supplied to the induction heating coil is adjusted to control the temperature of the fixing apparatus using the CPU, depending on processing speed of the CPU, it is likely that the supplied electric power cannot be instantaneously adjusted and controlled. Because of such a delay in control, it is likely that the temperature ripple of the fixing apparatus expands and, moreover, overshoot is caused. When the temperature of the fixing apparatus is overshot, it is likely that deterioration in an image quality due to high-temperature offset occurs. Furthermore, it is likely that the CPU cannot be controlled. Therefore, it cannot be said that this method is sufficiently safe.

Therefore, as the fixing apparatus of the induction heating system, development of a fixing device for an image forming apparatus is desired that holds a uniform fixing temperature and obtains a fixed image with a high quality even if the fixing apparatus adjusts and controls electric power supplied to an induction heating coil and has a small heat capacity. Moreover, development of a fixing apparatus for an image forming apparatus that is sufficiently safe and has high reliability is desired.

SUMMARY OF THE INVENTION

According to an aspect of the present invention, there is provided a fixing apparatus for an image forming apparatus that adjusts and controls electric power supplied to an induction heating coil of the fixing apparatus, realizes a reduction in a temperature ripple of the fixing apparatus, obtains a high image quality through improvement of fixing performance, and has high safety.

According to an embodiment of the present invention, there is provided a fixing apparatus including a heat generating member that has a metal conductive layer, an induction-current generation coil arranged around the heat generating member, a power supplying unit that outputs electric power to the induction-current generation coil, a temperature sensor arranged around the heat generating member, a control unit that compares a first reference temperature and a detection result of the temperature sensor and adjusts an output of the power supplying unit, and an ON-OFF unit that compares a second reference temperature and a detection result of the temperature sensor and turns on or off the power supplying unit.

DETAILED DESCRIPTION OF THE INVENTION

Figure 1:
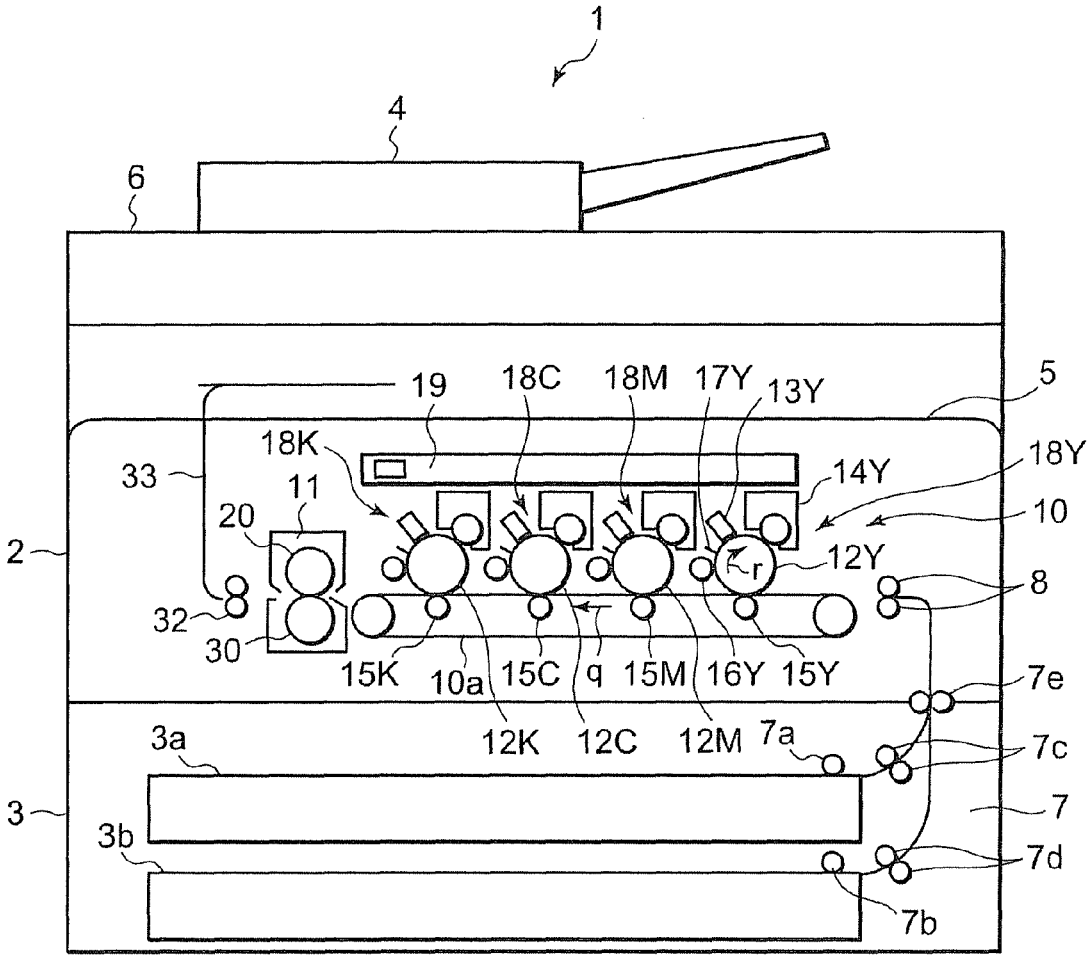
FIG. 1 is a schematic diagram showing an image forming apparatus according to an embodiment of the present invention.

An embodiment of the present invention will be hereinafter explained in detail with reference to the accompanying drawings. FIG. 1 is a schematic diagram showing an image forming apparatus 1 according to the embodiment. The image forming apparatus 1 includes a scanner unit 6 that scans an original and a paper feeding unit 3 that feeds sheet paper P to a printer unit 2 that forms an image. The scanner unit 6 converts image information read from an original supplied by an auto document feeder 4 provided on an upper surface thereof into an analog signal.

The printer unit 2 includes an image forming unit 10 in which image forming stations 18Y, 18M, 18C, and 18K for respective colors of yellow (Y), magenta (M), cyan (C), and black (K) are arranged in tandem along a transfer belt 10*a* rotated in an arrow "q" direction. The image forming unit 10 includes a laser exposure device 19 that irradiates a laser beam corresponding to image information on photoconductive drums 12Y, 12M, 12C, and 12K of the image forming stations 18Y, 18M, 18C, and 18K for the respective colors. Moreover, the printer unit 2 includes a fixing apparatus 11 and a paper discharge roller 40 and has a paper discharging and conveying path 41 that conveys the sheet paper P after fixing to a paper discharging unit 5.

In the image forming station 18Y for yellow (Y) of the image forming unit 10, a charger 13Y, a developing device 14Y, a transfer roller 15Y, a cleaner 16Y, and a charge removing device 17Y are arranged around the photoconductive drum 12Y that rotates in an arrow "r" direction. The image forming stations 18M, 18C, and 18K for the respective colors of magenta (M), cyan (C), and black (K) have the same structure as the image forming station 18Y for yellow (Y).

The paper feeding unit 3 includes first and second paper feeding cassettes 3*a* and 3*b*. In a conveying path 7 for the sheet paper P leading from the paper feeding cassettes 3*a* and 3*b* to the image forming unit 10, pickup rollers 7*a* and 7*b* that extract the sheet paper P from the paper feeding cassettes 3*a* and 3*b*, separating and conveying rollers 7*c* and 7*d*, conveying rollers 7*e*, and registration rollers 8 are provided.

When print operation is started, in the image forming station 18Y for yellow (Y) of the printer unit 2, the photoconductive drum 12Y is rotated in the arrow "r" direction and uniformly charged by the charger 13Y. Subsequently, exposure light corresponding to yellow image information scanned by the scanner unit 6 is irradiated on the photoconductive drum 12Y by the laser exposure device 19 and an electrostatic latent image is formed thereon. Thereafter, a toner is supplied to the photoconductive drum 12Y by the developing device 14Y and a toner image of yellow (Y) is formed on the photoconductive drum 12Y. The toner image of yellow (Y) is transferred onto the sheet paper P, which is conveyed in the arrow "q" direction on the transfer belt 10*a*, in the position of the transfer roller 15Y. After the transfer of the toner image is finished, a residual toner on the photoconductive drum 12Y is cleaned by the cleaner 16Y and the charge on the surface of the photoconductive drum 12Y is removed by the charge removing device 17Y, whereby the photoconductive drum 12Y is allowed to perform next printing.

In the image forming stations 18M, 18C, and 18K for the respective colors of magenta (M), cyan (C), and black (K), toner images are formed in the same manner as the image forming station 18Y for yellow (Y). The toner images of the respective colors formed in the image forming stations 18M, 18C, and 18K are sequentially transferred onto the sheet paper P, on which the yellow toner image is formed, in the positions of the respective transfer rollers 15M, 15C, and 15K. The sheet paper P having a color toner image formed thereon in this way is heated and pressed to have the color toner image fixed thereon and have a print image completed thereon by the fixing apparatus 11 and is discharged to the paper discharging unit 5.

Figure 2:
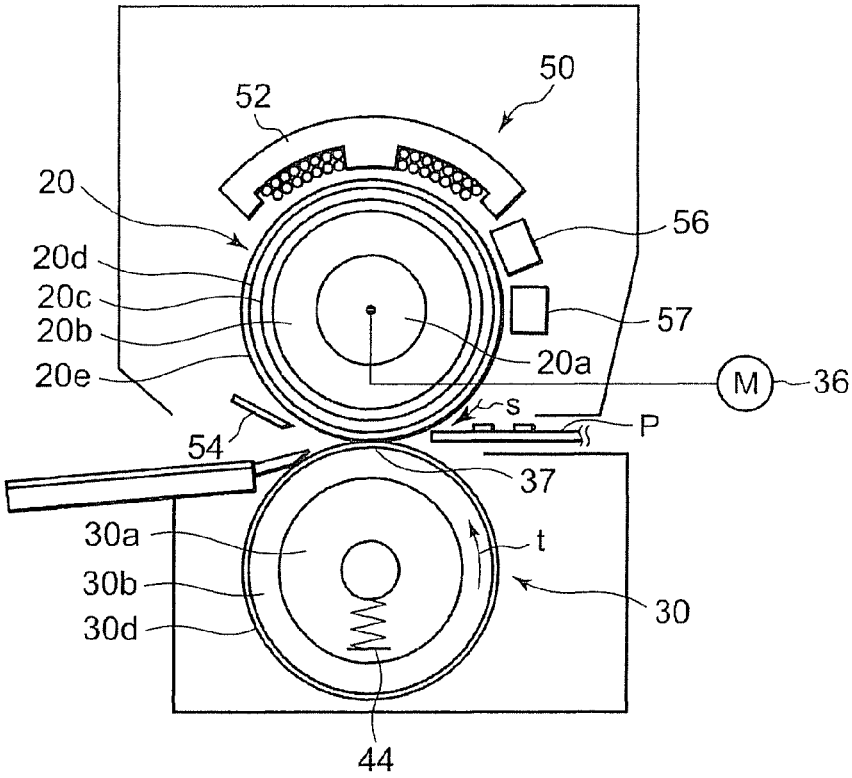
FIG. 2 is a schematic diagram showing a fixing apparatus according to the embodiment.

The fixing apparatus 11 is described below. FIG. 2 is a schematic diagram showing the fixing apparatus 11. The fixing apparatus 11 has a heat roller 20 as a heat generating member and a press roller 30. Diameters of the heat roller 20 and the press roller 30 are set to 40 mm, respectively. The heat roller 20 is driven in an arrow "s" direction by a fixing motor 36. The press roller 30 is brought into press contact with the heat roller 20 by a pressing mechanism that has a spring 44. Consequently, a nip 37 having a fixed width is formed between the heat roller 20 and the press roller 30. The press roller 30 is rotated in an arrow "t" direction following the heat roller 20.

The heat roller 20 has, around a metal shaft 20*a*, foamed rubber (sponge) 20*b* having the thickness of 5 mm, a metal conductive layer 20*c* of nickel (Ni) having the thickness of 40 μm, a solid rubber layer 20*d* having the thickness of 200 μm, and a release layer 20*e* having the thickness of 30 μm. A material of the metal conductive layer 20*c* is not limited to nickel and may be stainless steel, aluminum, a composite material of stainless steel and aluminum, or the like. The metal conductive layer 20*c*, the solid rubber layer 20*d*, and the release layer 20*e* may be integrated and not bonded to the foamed rubber (sponge) 20*b* to allow the layers to slide with respect to the foamed rubber (sponge) 20*b*.

The press roller 30 is constituted by coating the metal shaft 30*a* with the silicon rubber layer 30*b* and the release layer 30*d*.

On an outer periphery of the heat roller 20, a peeling pawl 54, an induction heating coil 50 as an induction-current generation coil, an infrared sensor 56 of a thermopile system as a temperature sensor, and a thermostat 57 are provided. The peeling pawl 54 prevents the sheet paper P after fixing from twining around the heat roller 20. The peeling pawl 54 may be either a contact type or a non-contact type. The induction heating coil 50 is provided at a predetermined gap in the outer periphery of the heat roller 20 and causes the metal conductive layer 20*c* of the heat roller 20 to generate heat. The infrared sensor 56 detects a surface temperature in substantially the center of the heat roller 20 in a non-contact manner and converts the surface temperature into a voltage. The thermostat 57 detects abnormality of the surface temperature of the heat roller 20 and forcibly turns off the supply of electric power to the induction heating coil 50. When the surface temperature of the heat roller 20 rises because of, for example, trouble of a CPU 62 described later and reaches a third reference temperature set in advance, the thermostat 57 forcibly turns off the supply of electric power to the induction heating coil 50.

The induction heating coil 50 has a shape substantially coaxial with the heat roller 20 and is formed by winding a wire around a magnetic core 52 for focusing a magnetic flux on the heat roller 20. As the wire, for example, a litz wire formed by binding plural copper wires coated with heat-resistant polyamide-imide and insulated from one another is used. By using the litz wire as the wire, it is possible to set a diameter of the wire smaller than the depth of penetration of a magnetic field. This makes it possible to effectively feed a high-frequency current to the wire. In this embodiment, nineteen copper wires having a diameter of 0.5 mm are bound to form the litz wire.

When a predetermined high-frequency current is supplied to such a litz wire, the induction heating coil 50 generates a magnetic flux. An eddy-current for preventing a change in a magnetic field is generated in the metal conductive layer 20*c* by this magnetic flux. Joule heat is generated by this eddy-current and the resistance of the metal conductive layer 20*c* and the heat roller 20 is instantaneously caused to generate heat.

Figure 3:
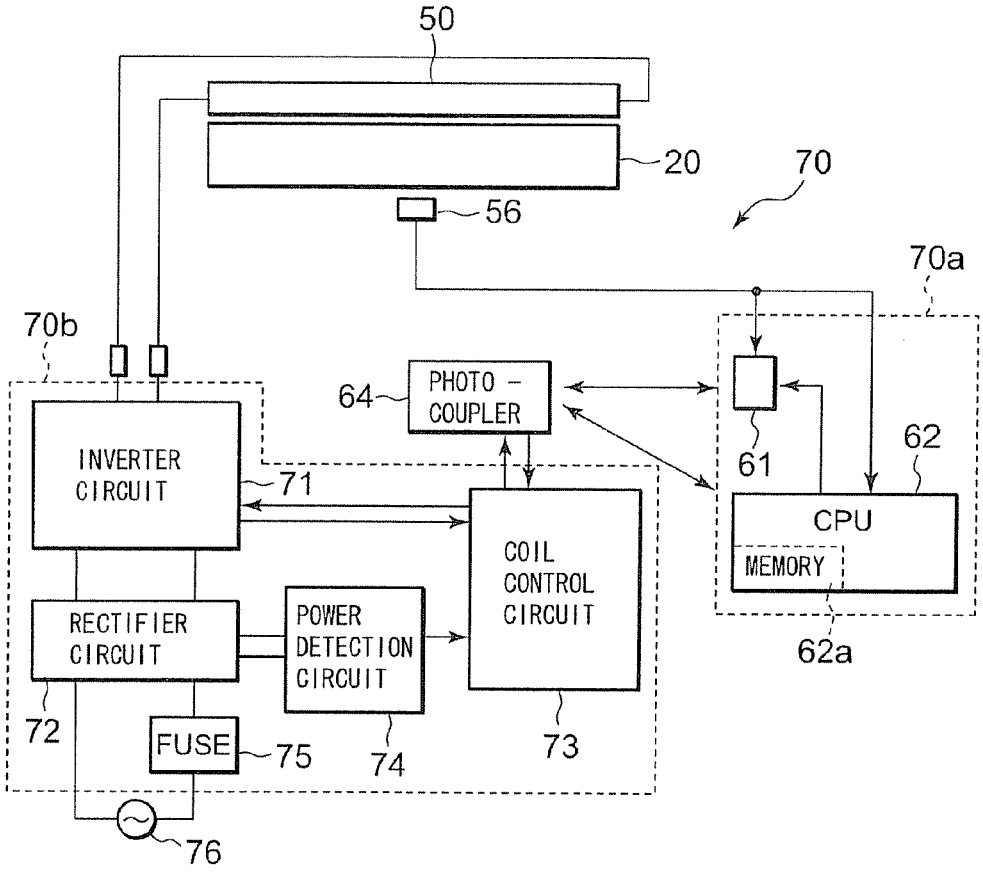
FIG. 3 is a schematic block diagram showing a control system of an induction heating coil according to the embodiment.

A control system 70 of the induction heating coil 50 that causes the heat roller 20 to generate heat is described with reference to FIG. 3. The control system 70 has a temperature comparator 61 and a CPU 62 on a secondary side 70*a*. The control system 70 has an inverter circuit 71 that is a power supplying unit and supplies driving power to the induction heating coil 50, a rectifier circuit 72 that rectifies an electric current from a commercial AC power supply 76 and supplies the electric current to the inverter circuit 71, a coil control circuit 73, a power detection circuit 74 that detects an output of the rectifier circuit 72 and feeds back the output to fix electric power, and a fuse 75 on a primary side 70*b*.

Signals from the temperature comparator 61 and the CPU 62 on the secondary side 70*a* are transmitted to the coil control circuit 73 on the primary side 70*b* through a photo-coupler 64. By using the photo-coupler 64, it is possible to insulate the secondary side 70*a* and the primary side 70*b* of the control system 70 from each other.

A signal for instructing to turn on or off the supply of electric power by the inverter circuit 71 is transmitted from the temperature comparator 61 to the coil control circuit 73. A signal for instructing to adjust the supply of electric power from the inverter circuit 71 is transmitted from the CPU 62 to the coil control circuit 73. When a signal is transmitted from the secondary side 70*a* of the control system 70 to the photo-coupler 64, the photo-coupler 64 is turned on. Therefore, the coil control circuit 73 and the inverter circuit 71 operate, a high-frequency current is fed to the induction heating coil 50, a power value is adjusted, and high-frequency power is turned off.

Figure 4:
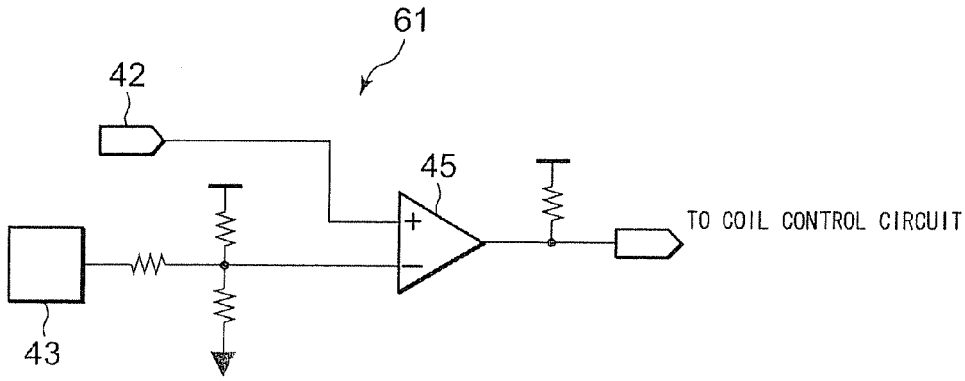
FIG. 4 is a block diagram showing a temperature comparator according to the embodiment.

The temperature comparator 61 operates when the temperature of the heat roller 20 exceeds the second reference temperature even if an output value to the induction heating coil 50 by the CPU 62 decreases to an adjustable minimum output value. As shown in FIG. 4, the temperature comparator 61 has a comparator 45 that compares a reference voltage corresponding to the second reference temperature inputted from a reference-value input terminal 42 and a detected voltage corresponding to a detection result of the infrared sensor 56 inputted from a measurement-value input terminal 43. When the detected voltage exceeds a reference voltage in the comparator 45, the temperature comparator 61 transmits an OFF signal to the photo-coupler 64. When the detected voltage is lower than the reference voltage in the comparator 45, the temperature comparator 61 outputs an ON signal to the photo-coupler 64. The second reference temperature is variable and is set in accordance with, for example, a relative relation with the first reference temperature described later.

The CPU 62 controls the entire image forming apparatus 1 and changes a bit value of a signal transmitted to the photo-coupler 64 to thereby instruct the coil control circuit 73 to adjust high-frequency power supplied to the induction heating coil 50 by the inverter circuit 71. The coil control circuit 73 feedback-controls high-frequency power, which is electric power supplied to the induction heating coil 50 by the inverter circuit 71 according to a detection result of the infrared sensor 56. The CPU 62 compares the first reference temperature and the detection result of the infrared sensor 56 and controls the signal transmitted to the photo-coupler 64. A plurality of the first reference temperatures are set in advance according to control temperatures of the heat roller 20 during various modes of the fixing apparatus 11.

When the detection result of the infrared sensor 56 is lower than the first reference temperature, the CPU 62 controls the electric power supplied to the induction heating coil to increase. When the detection result of the infrared sensor 56 is higher than the first reference temperature, the CPU 62 controls the electric power supplied to the induction heating coil 50 to decrease. The CPU 62 has a memory 62*a* that stores the first to third reference temperatures and the like.

Figure 5:
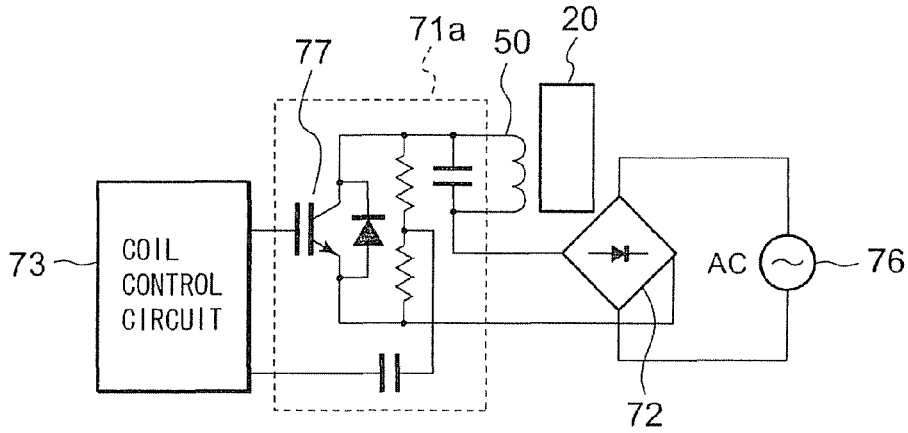
FIG. 5 is a schematic diagram showing a state in which a new class E inverter circuit is used in a part of the control system in the embodiment.
Figure 6:
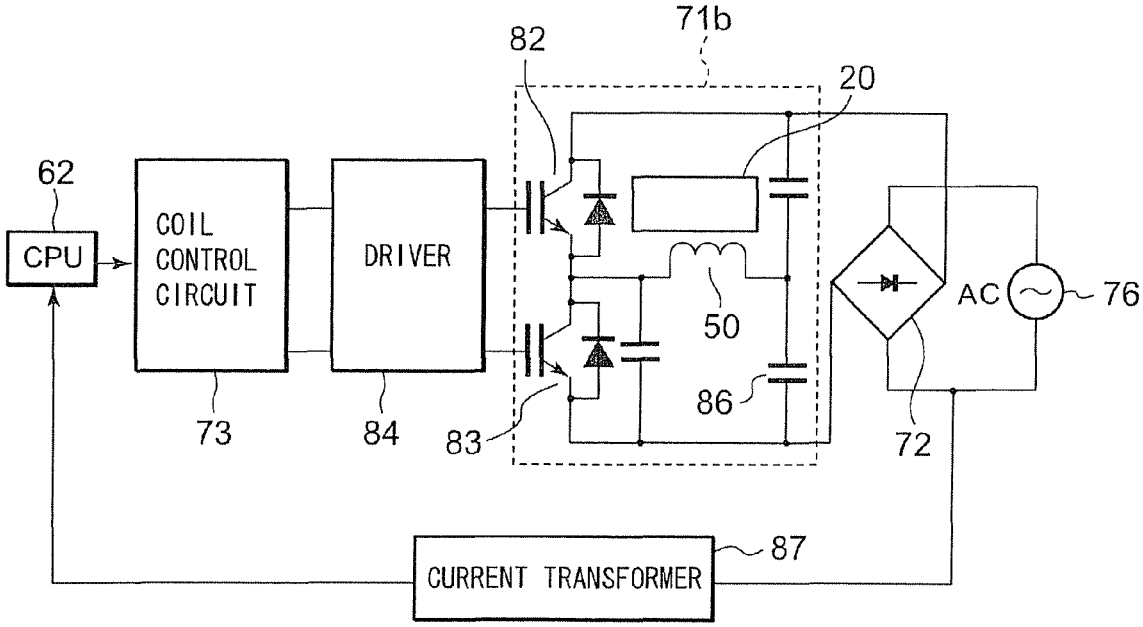
FIG. 6 is a schematic diagram showing a state in which a half-bridge inverter circuit is used in a part of the control system in the embodiment.

As the inverter circuit 71, it is possible to use, for example, a new class E inverter circuit 71*a* shown in FIG. 5 or a half-bridge inverter circuit 71*b* shown in FIG. 6. In this embodiment, for example, when the half-bridge inverter circuit 71*b* is used, the commercial AC power supply 76 is rectified by the rectifier circuit 72 including a diode bridge. A driving frequency of a rectified current is varied by the half-bridge inverter circuit 71*b*, which is controlled by a driver 84 driven by the coil control circuit 73 that receives a signal from the CPU 62.

In other words, two switching transistors 82 and 83 connected in series are alternately energized by the driver 84. Consequently, a high-frequency current is supplied to the induction heating coil 50 and a resonant capacitor 86 of a series resonant circuit. An operating frequency of the high-frequency current controls ON and OFF time of switching transistors 82 and 83 such that a current value of a current transformer 87 that detects an electric current between the commercial AC power supply 76 to the rectifier circuit 72 coincides with a current value instructed by the CPU 62. A desired operating frequency can be obtained by causing the current value of the current transformer 87 to coincide with the current value instructed by the CPU 62. Consequently, electric power supplied to the induction heating coil 50 can be adjusted to a desired power value.

As the inverter circuit 71 on the primary side 70*b* of the control system 70, as shown in FIG. 5, the new class E inverter circuit 71*a* may be used. The new class E inverter circuit 71*a* controls an ON-OFF time of a single switching element 77 with the coil control circuit 73 and varies a driving frequency of an electric current supplied to the induction heating coil 50. By varying the driving frequency, it is possible to adjust the electric power supplied to the induction heating coil 50.

Temperature control for the heat roller 20 and setting of the reference temperatures by the control system 70 are described. In a standby mode of the image forming apparatus 1, a roller control temperature of the heat roller 20, which is the first reference temperature, is set to, for example, 150° C. by the CPU 62 in advance. During the standby mode, electric power of 500 W is supplied to the induction heating coil 50 by the inverter circuit 71. In a fixing mode of the image forming apparatus 1, the roller control temperature of the heat roller 20, which is the first reference temperature, is set to, for example, 170° C. by the CPU 62 in advance. During the fixing mode, electric power of 900 W is supplied to the induction heating coil 50 by the inverter circuit 71.

When warming-up is started by turning on a power supply, first, for example, electric power of 900 W is supplied to the induction heating coil 50 by the inverter circuit 71. Consequently, the heat roller 20 is heated to the control temperature. Thereafter, electric power of 500 W is supplied to the induction heating coil 50 by the inverter circuit 71. When the heat roller 20 reaches the control temperature in the standby mode, the CPU 62 controls the coil control circuit 73 according to a detection result of the infrared sensor 56 such that the heat roller 20 holds the control temperature of 150° C. Consequently, the inverter circuit 71 adjusts a power value supplied to the induction heating coil 50. When the image forming apparatus 1 enters the fixing mode according to a print instruction and the heat roller 20 reaches the control temperature in the fixing mode, the CPU 62 controls the coil control circuit 73 according to a detection result of the infrared sensor 56 such that the heat roller 20 holds the control temperature of 170° C. Consequently, the inverter circuit 71 adjusts a power value supplied to the induction heating coil 50.

Temperature control for holding the heat roller 20 at the first reference temperature is described below. The temperature control for the heat roller 20 is performed at two stages including adjustment and control of a power value supplied to the induction heating coil 50 by the CPU 62 and On-OFF control for electric power to the induction heating coil 50 by the temperature comparator 61. At both the stages, a surface temperature of the heat roller 20 is detected by the infrared sensor 56 and feed-back controlled.

Figure 7:
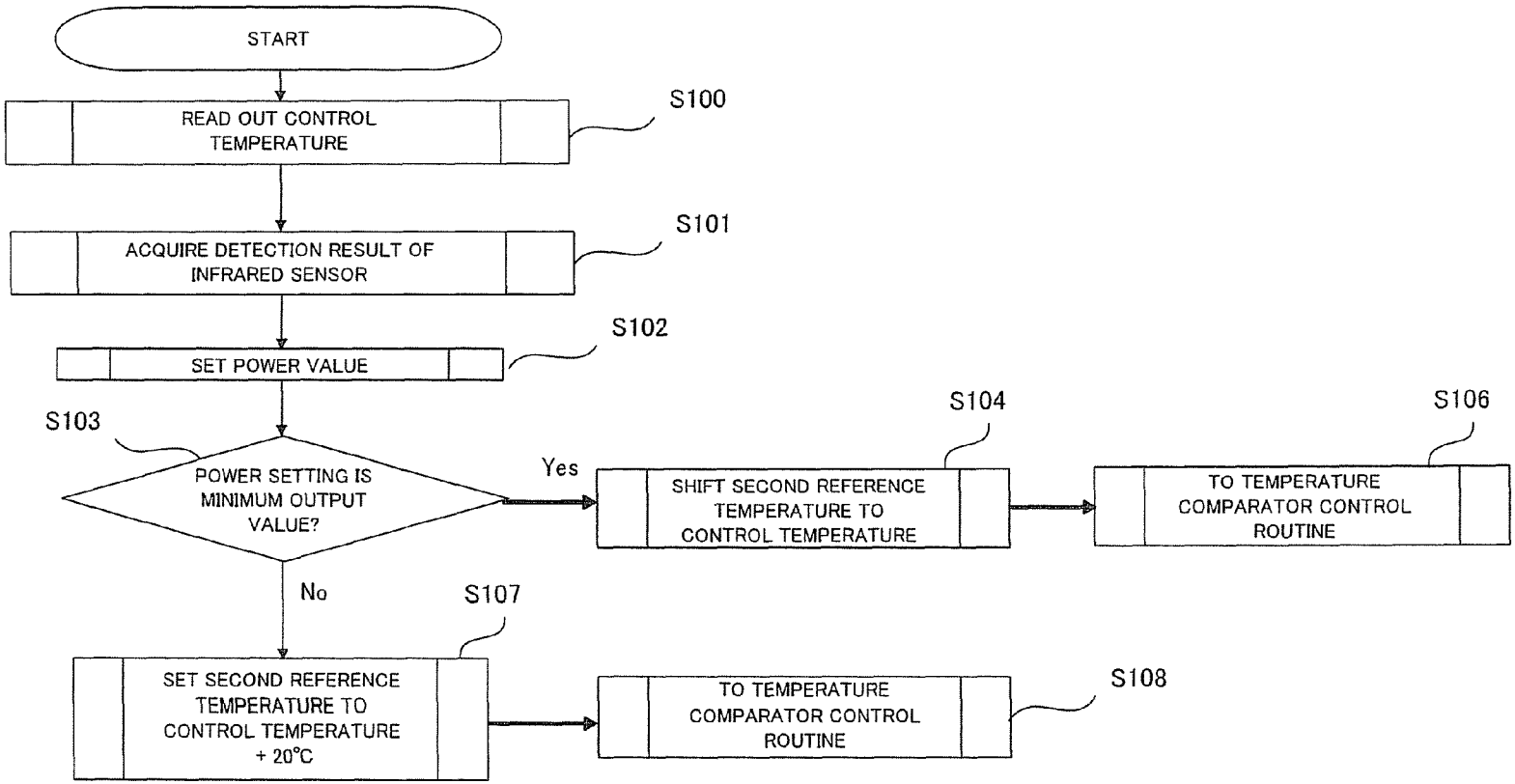
FIG. 7 is a flowchart showing a method of setting a second reference temperature according to the embodiment.

A flowchart for setting the second reference temperature of the temperature comparator 61 is shown in FIG. 7. When temperature control operation is started, the CPU 62 reads out the control temperature as the first reference temperature from the memory 62*a* according to a mode of the fixing apparatus 11 (step 100). When the fixing apparatus 11 is in the standby mode, the CPU 62 reads out the control temperature of 150° C. from the memory 62*a*. On the other hand, when the fixing apparatus 11 is in the fixing mode, the CPU 62 reads out the control temperature of 170° C. Subsequently, the CPU 62 acquires a detected voltage corresponding to a detection result of a surface temperature of the heat roller 20 by the infrared sensor 56 (step 101).

Figure 8:
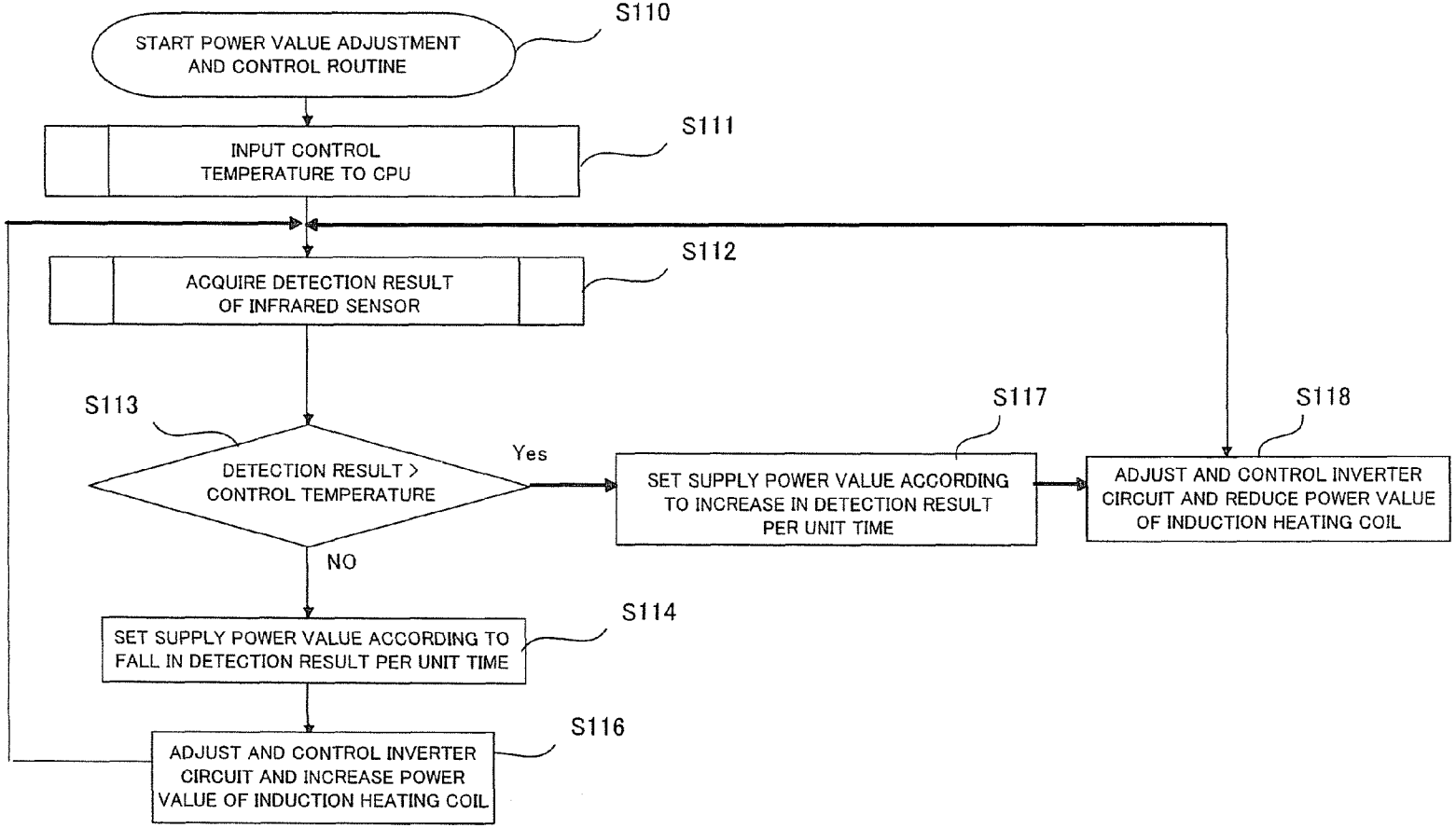
FIG. 8 is a flowchart showing temperature control for a heat roller by a CPU according to the embodiment.

Thereafter, in accordance with a flowchart shown in FIG. 8, the CPU 62 sets a power value supplied to the induction heating coil 50 (step 102). The CPU 62 judges whether the power value set in step 102 is a minimum output value (e.g., equal to or lower than 200 W), which is a minimum limit adjustable to be outputted to the induction heating coil 50 (step 103). When the set power value supplied to the induction heating coil 50 is the minimum output value, the CPU 62 proceeds to step 104 and changes the setting of the second reference temperature to be the same as the first reference temperature. For example, in the case of the fixing mode, the CPU 62 changes the setting of the second reference temperature to the same temperature as the control temperature of 170° C. Thereafter, the CPU 62 proceeds to a temperature comparator control routine shown in FIG. 9 (step 106).

This takes into account the fact that, in adjustment and control of supply power by the CPU 62 described later, when a power value reaches an adjustable minimum output value (e.g., equal to or lower than 200 W), the power value cannot be lowered below the minimum output value. For example, usually, when a surface temperature of the heat roller 20 is higher than a target control temperature, the CPU 62 holds the control temperature by gradually reducing supply power from the inverter circuit 71 by the CPU 62. However, when the surface temperature of the heat roller 20 still exceeds the target control temperature even if the supply power is reduced to 200 W, the power value cannot be further reduced and it is impossible to perform the temperature control by the adjustment of the power value. Therefore, when the power value has reached the adjustable minimum output value in this way, the temperature control is performed by the temperature comparator 61 instead of the CPU 62. Therefore, the second reference temperature is set to be the same as the control temperature of 170° C. in advance and, when the surface temperature of the heat roller 20 has reached 170° C., the temperature comparator 61 controls the inverter circuit 71 to be turned off. In this way, the heat roller 20 is held at the control temperature.

On the other hand, when the set power value is not the minimum output value in step 103 in FIG. 7, the temperature comparator 61 proceeds to step 107 and sets the second reference temperature to (the first reference temperature +20° C.). For example, in the case of the fixing mode, the second reference temperature is usually set to 190° C., which is 20° C. higher than the control temperature. Thereafter, the CPU 62 proceeds to the temperature comparator control routine shown in FIG. 9 (step 108).

This is because, first, the temperature control for the heat roller 20 is performed by the adjustment and control of supply power by the CPU 62 described later. In other words, the control by the temperature comparator 61 is control means adopted next when the temperature control for the heat roller 20 by the CPU 62 is insufficient. Therefore, prior to the control by the CPU 62, the second reference temperature is set 20° C. higher than the control temperature to prevent the temperature comparator 61 from operating earlier than the CPU 62. In this embodiment, the second reference temperature (e.g., 190° C.) usually set is an upper limit value of temperature at which no problem is caused in image performance during toner fixing. If the second reference temperature is set in this way, a temperature range in which temperature can be adjusted and controlled by the CPU 62 is increased.

The adjustment and control of a power value of the inverter circuit 71 by the CPU 62 (corresponding to step 102) for holding the heat roller 20 at the first reference temperature is described below. A flowchart of the adjustment and control is shown in FIG. 8. For example, during the fixing mode, a power value adjustment control routine is started to hold the heat roller 20 at the control temperature of 170° C. (step 110). The control temperature (170° C.) during the fixing mode, which is the first reference temperature, is inputted to the CPU 62 from the memory 62*a* (step 111). The CPU 62 acquires a detection result from the infrared sensor 56 as a voltage (step 112). The CPU 62 compares the control temperature (170° C.) and the detection result (step 113). When the detection result is lower than the control temperature, the CPU 62 proceeds to step 114.

In step 114, the CPU 62 sets a power value supplied from the inverter circuit 71 to the induction heating coil 50 according to a degree of the fall in a unit time of the detection result with respect to the control temperature. For example, when a surface temperature of the heat roller 20 has fallen 5° C. in one second, the CPU 62 sets the supply power to be increased by 100 W and sets electric power of 1000 W to be supplied to the induction heating coil 50. The CPU 62 transmits a control signal to the coil control circuit 73 on the primary side 70*b* through the photo-coupler 64. Consequently, the inverter circuit 71 driven by the coil control circuit 73 is adjusted and controlled to increase electric power supplied to the induction heating coil 50 and the electric power of 1000 W is supplied to the induction heating coil 50 (step 116). Thereafter, the CPU 62 returns to step 112 and repeats the temperature control for the heat roller 20.

When the detection result is higher than the control temperature in step 113, the CPU 62 proceeds to step 117. In step 117, the CPU 62 sets electric power supplied from the inverter circuit 71 to the induction heating coil 50 according to a degree of the increase of the detection result in a unit time with respect to the control temperature. For example, when a surface temperature of the heat roller 20 rises 10° C. in one second, the CPU 62 sets supply power to be reduced by 200 W and sets electric power of 700 W to be supplied to the induction heating coil 50. The CPU 62 transmits a control signal to the coil control circuit 73 through the photo-coupler 64. The inverter circuit 71 driven by the coil control circuit 73 is adjusted and controlled to reduce electric power supplied to the induction heating coil 50 and the electric power of 700 W is supplied to the induction heating coil 50 (step 118). Thereafter, the CPU 62 returns to step 112 and repeats the temperature control for the heat roller 20.

For the temperature control for the heat roller 20, instead of ON-OFF controlling the inverter circuit 71, the CPU 62 adjusts and controls an output voltage of the inverter circuit 71. When the image forming apparatus 1 is in the standby mode, the CPU 62 adjusts and controls an output value of the inverter circuit 71 in the same manner. However, in this embodiment, the control temperature of the heat roller 20 during the standby mode is set to 150° C.

The adjustment and control of the inverter circuit 71 is not limited to the adjustment according to temperature variation of the heat roller 20. For example, the adjustment and control may be controlled in such a manner as to reduce the supply power by a fixed amount when the surface temperature of the heat roller 20 has reached the control temperature and, on the other hand, increase the supply power by a fixed amount when the surface temperature falls below the control temperature by a predetermined temperature.

Figure 9:
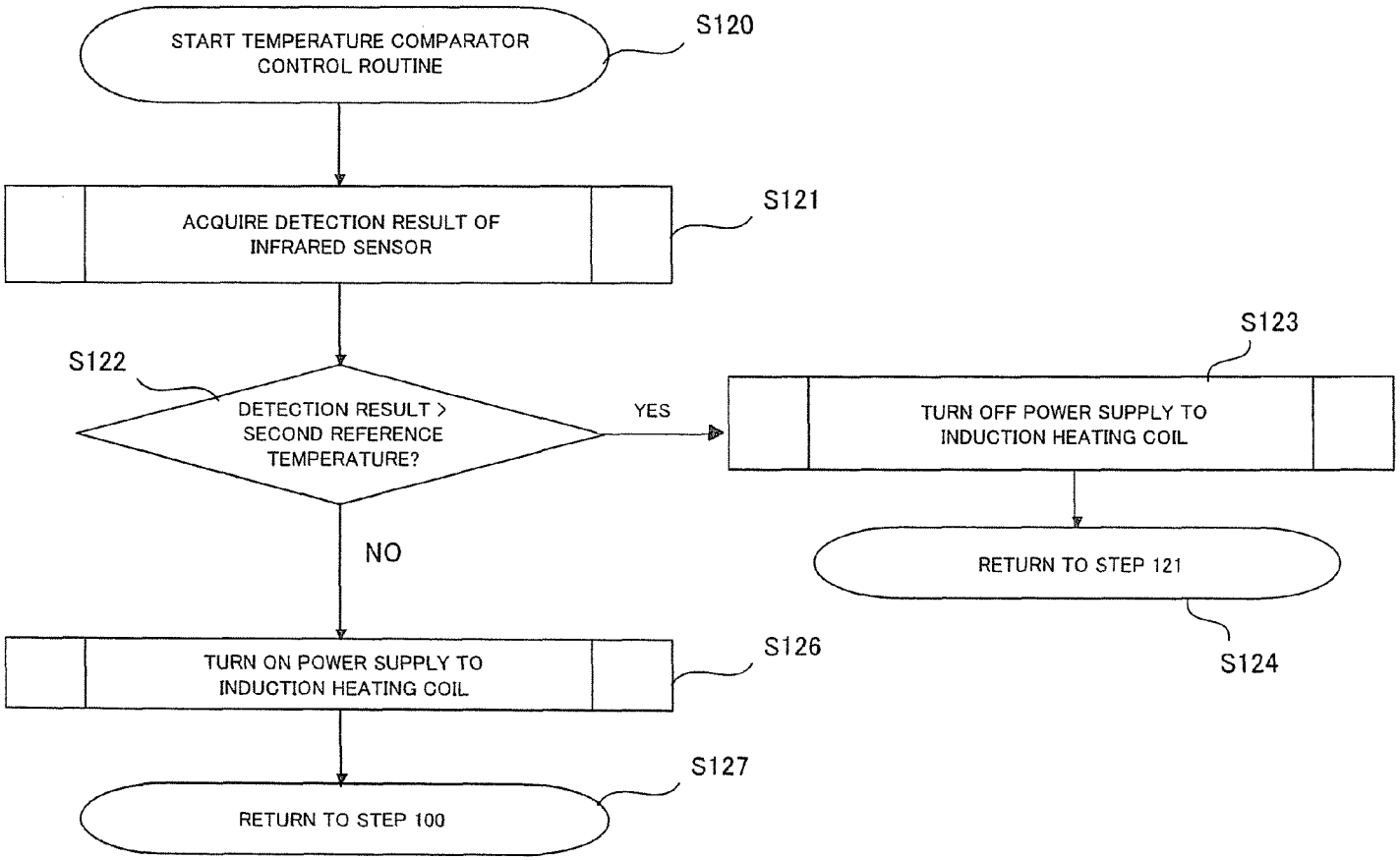
FIG. 9 is a flowchart showing temperature control for the heat roller by a temperature comparator according to the embodiment.

In order to hold the heat roller 20 at the first reference temperature, the temperature comparator 61 ON-OFF controls electric power supplied to the induction hating coil 50. This processing is described below. The ON and OFF control of the supply power by the temperature comparator 61 is performed when the surface temperature of the heat roller 20 is not sufficiently controlled even if the adjustment and control of the supply power is performed by the CPU 62. Consequently, a temperature ripple of the heat roller 20 is reduced to improve fixability and improve safety of the image forming apparatus 1. A flowchart of the ON and OFF control is shown in FIG. 9.

The temperature comparator control routine is started under the condition set in step 104 or step 107 in FIG. 7 (step 120). In starting the temperature comparator control routine, it is assumed that a surface temperature of the heat roller 20 exceeds the control temperature and a power value supplied to the induction heating coil 50 is reduced to the minimum output value. In this case, for example, during the fixing mode, the second reference temperature is changed to temperature same as the temperature of 170° C. during the fixing mode. On the other hand, when the power value supplied to the induction heating coil 50 is larger than the minimum output value, the second reference temperature is set to 190° C., which is 20° C. higher than the temperature of 170° C. during the fixing mode. In such a state, the temperature comparator 61 acquires a detection result from the infrared sensor 56 as a voltage (step 121).

Subsequently, the temperature comparator 61 compares the second reference temperature set in step 104 or step 107 and the detection result (step 122). When the detection result is higher than the second reference temperature, the temperature comparator 61 proceeds to step 123. In step 123, the temperature comparator 61 outputs an OFF signal to the coil control circuit 73 and turns off the supply of electric power to the induction heating coil 50 by the inverter circuit 71. Thereafter, the temperature comparator 61 returns to step 121 (step 124).

In step 123, the temperature comparator 61 turns off the supply of electric power to the induction heating coil 50 by the inverter circuit 71. Since the OFF control of the supply of electric power to the induction heating coil 50 by the temperature comparator 61 is not performed through the CPU 62, control speed is high. Therefore, when speed of power value adjustment and control by the CPU 62 is low, it is possible to quickly control the temperature of the heat roller 20 and prevent a temperature ripple of the heat roller 20 through the operation of the temperature comparator 61.

For example, in the heat roller 20 having a small heat capacity, temperature fluctuation suddenly occurs on the surface of the heat roller 20. Therefore, if the control of adjustment of a power value by the CPU 62 is slow, it is likely that the temperature of the heat roller 20 far exceeds the target control temperature. In such a case, if supply power is immediately OFF-controlled by the temperature comparator 61, it is possible to effectively prevent a temperature ripple of the heat roller 20. As a result, a high-quality fixed image is obtained. Further, for example, while the CPU 62 is performing another operation, processing speed for the temperature control for the heat roller 20 may fall. When the processing speed of the CPU 62 falls, it is likely that the temperature of the heat roller 20 exceeds the control temperature. In such a case, when the temperature of the heat roller 20 reaches the second reference temperature, the supply power is immediately OFF-controlled by the temperature comparator 61. Therefore, it is possible to reduce the temperature ripple and hold a high-quality fixed image.

Moreover, for example, even when the power value adjustment and control by the CPU 62 becomes impossible, when the temperature of the heat roller 20 reaches the second reference temperature, the temperature comparator 61 immediately OFF-controls supply power. Therefore, it is unlikely that the heat roller 20 is heated to an abnormal temperature. Since the temperature comparator 61 uses only the comparator 45, failure of the temperature comparator 61 is extremely rare and safety of the image forming apparatus 1 is more surely obtained.

On the other hand, when the detection result is lower than the second reference temperature in step 122, the temperature comparator 61 proceeds to step 126. In step 126, the temperature comparator 61 outputs an ON signal to the coil control circuit 73 and turns on the supply of electric power to the induction heating coil 50 by the inverter circuit 71. Thereafter, the temperature comparator 61 returns to step 100 in FIG. 7 (step 127).

When the control of the inverter circuit 71 becomes impossible because of a deficiency while the CPU 62 and the temperature comparator 61 perform the temperature control for the heat roller 20 in this way, the thermostat 57 operates. Even when a surface temperature of the heat roller 20 has reached the second reference temperature, when the temperature comparator 61 does not operate and the surface temperature of the heat roller 20 reaches the third reference temperature, the thermostat 57 detects temperature abnormality and forcibly turns off the inverter circuit 71. Consequently, the heat roller 20 is not abnormally caused to generate heat and safety of the image forming apparatus 1 is further improved.

In the fixing apparatus 11 according to this embodiment, the control system 70 of the induction heating coil 50 adjusts and controls, according to the control by the CPU 62, a power value supplied to the induction heating coil 50 by the inverter circuit 71. Therefore, it is possible to more highly accurately control the temperature of the heat roller 20 with a more suitable power amount. Consequently, it is possible to easily hold a surface temperature of the heat roller 20 at a fixed temperature with a less temperature ripple, improve fixing performance, and save electric power.

Moreover, the control system 70 of the induction heating coil 50 includes the temperature comparator 61, ON or OFF controls a power value supplied to the induction heating coil 50 by the inverter circuit 71, and covers the adjustment and control of the power value by the CPU 62. The temperature comparator 61 operates earlier than the CPU 62, for example, when a heat capacity of the heat roller 20 is small or when control speed of the CPU 62 is low. According to the quick ON-OFF control by the temperature comparator 61, it is possible to prevent a temperature ripple due to a delay in the control by the CPU 62 and maintain high fixing performance. Since the temperature comparator 61 having the simple structure is rarely broken down, it is possible to improve safety of the temperature control for the heat roller 20.

The present invention is not limited to the embodiment described above. Various modifications of the present invention are possible without departing from the spirit of the present invention. For example, the first to third reference temperatures including the control temperature of the heat generating member are arbitrarily set according to performance of the image forming apparatus, a characteristic of the fixing apparatus, or the like. A power value supplied to the induction-current generation coil is also arbitrarily set according to a heat capacity of the fixing apparatus or the like. Instead of providing the single induction heating coil, the induction heating coil may be divided into plural coils to cause predetermined areas of the heat generating member to generate heat, respectively.

Figure 10:
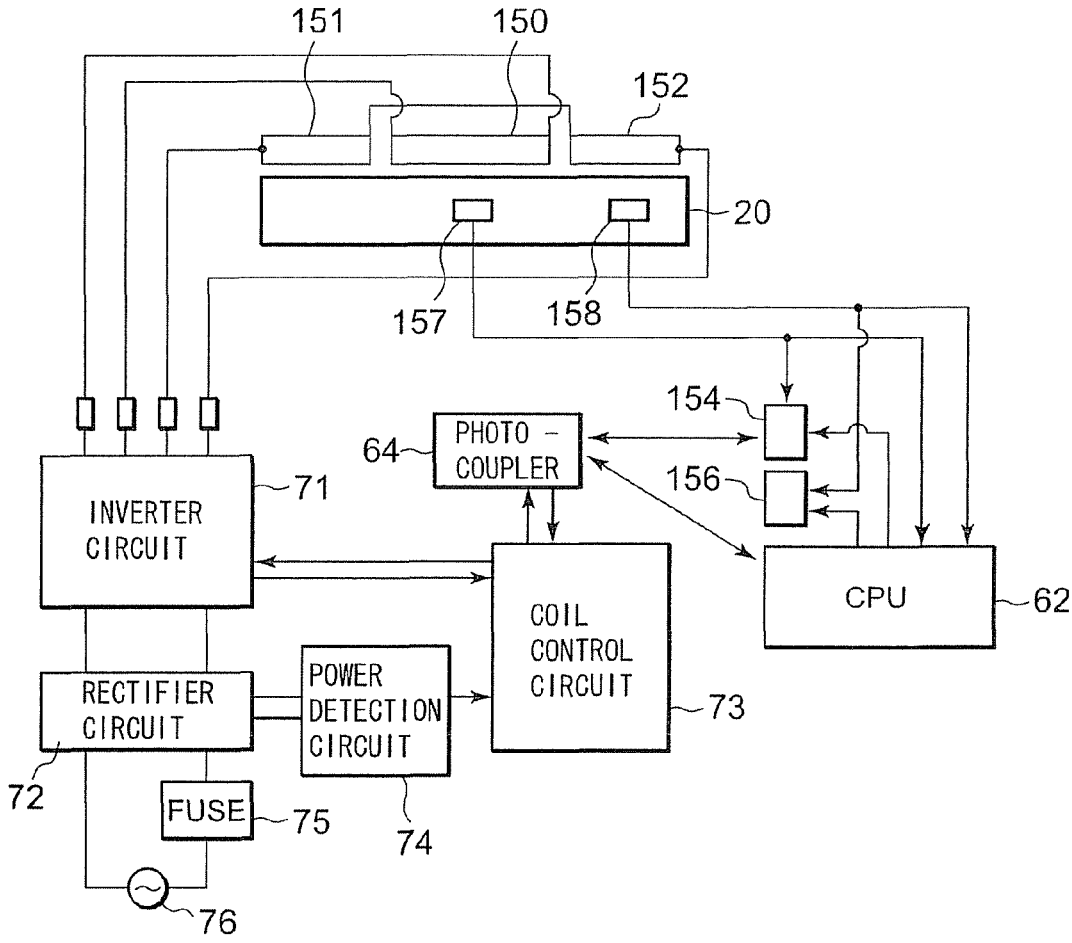
FIG. 10 is a schematic block diagram showing a control system for an induction heating coil according to a modification of the present invention.

For example, as indicated by a modification shown in FIG. 10, the center of the heat roller 20 may be caused to generate heat by a first induction heating coil 150 and both sides of the heat roller 20 may be caused to generate heat by second and third induction heating coils 151 and 152 connected in series. In this modification, a detection result of a first sensor 157 is fed back to the CPU 62 and a first temperature comparator 154. The CPU 62 and the first temperature comparator 154 perform power control for the first induction heating coil 150. A detection result of a second sensor 158 is fed back to the CPU 62 and a second temperature comparator 156. The CPU 62 and the second temperature comparator 156 perform power control for the second and third induction heating coils 151 and 152. When the plural induction heating coil 150 to 152 are used in this way, in order to uniformalize a surface temperature of the heat roller 20 over the entire length of thereof, for example, the CPU 62 compares the detection results of the first and second sensors 157 and 158 and performs control to supply electric power to the induction heating coil on a side where the surface temperature of the heat roller 20 is low.

What is claimed is:

1. A fixing apparatus comprising:

a heat generating member that has a metal conductive layer;

an induction-current generation coil arranged around the heat generating member;

a power supplying unit configured to output electric power to the induction-current generation coil;

a temperature sensor arranged around the heat generating member;

a processor configured to compare a first reference temperature for adjusting an output of the power supplying unit and a detection result of the temperature sensor and adjust the output of the power supplying unit; and an ON-OFF switch, which is different from the processor, configured to compare a second reference temperature for turning on or off the power supplying unit and a detection result of the temperature sensor and turn on or off the power supplying unit if the processor fails to adjust the output of the power supplying unit within a defined time.

2. A fixing apparatus according to claim 1, wherein the second reference temperature is set to be equal to or higher than the first reference temperature.

3. A fixing apparatus according to claim 1, wherein the processor varies the output of the power supplying unit according to a difference between the first reference temperature and the detection result of the temperature sensor.

4. A fixing apparatus according to claim 1, wherein if the output of the power supplying unit is not a minimum output at an adjustable limit, the second reference temperature is set to be larger than the first reference temperature.

5. A fixing apparatus according to claim 1, wherein the ON-OFF switch includes a temperature comparator.

6. A fixing apparatus according to claim 5, wherein the temperature comparator outputs an OFF signal to the power supplying unit at a time of the detection result of the temperature sensor exceeds the second reference temperature.

7. A fixing apparatus according to claim 5, wherein the temperature comparator continues output of an ON signal to the power supplying unit when the detection result of the temperature sensor is lower than the second reference temperature.

8. A fixing apparatus according to claim 1, wherein the processor adjusts the output of the power supplying unit according to a temperature difference in a unit time between the first reference temperature and the detection result of the temperature sensor.

9. A fixing apparatus according to claim 8, wherein the processor increases the output of the power supplying unit at a time of the detection result of the temperature sensor is lower than the first reference temperature.

10. A fixing apparatus according to claim 8, wherein the processor reduces the output of the power supplying unit at a time of the detection result of the temperature sensor is higher than the first reference temperature.

11. A fixing apparatus according to claim 1, further comprising a thermostat arranged around the heat generating member.

12. A fixing apparatus according to claim 1, wherein a plurality of the induction-current generation coils are arranged around the heat generating member.

13. A fixing apparatus according to claim 1, wherein, the second reference temperature is changed at a time of the output of the power supplying unit is a minimum output of and adjustable limit, and the detection result from the temperature sensor exceeds a predetermined temperature.

14. A fixing apparatus according to claim 13, wherein the second reference temperature is changed to be the same as the first reference temperature.

15. A fixing apparatus according to claim 1, wherein, the ON-OFF switch turns off the power supplying unit immediately if a detection result of the temperature sensor reaches the second reference temperature.

16. A method of controlling a fixing apparatus comprising:

setting a first reference temperature for adjusting supply power to an induction-current generation coil arranged around a heat generating member and a second reference temperature for turning on and off the supply power to the induction-current generation coil;

comparing the first reference temperature and temperature of the heat generating member;

adjusting the supply power to the induction-current generation coil according to a result of the comparison of the first reference temperature and the temperature of the heat generating member;

comparing the second reference temperature and the temperature of the heat generating member; and turning on and off the supply power to the induction-current generation coil according to a result of the comparison of the second reference temperature and the temperature of the heat generating member if the adjusting the supply power to the induction-current generation coil is late.

17. A method of controlling a fixing apparatus according to claim 16, wherein, the second reference temperature is set to be higher than the first reference temperature at a time of the supply power to the induction-current generation coil is not a minimum output at an adjustable limit.

18. A method of controlling a fixing apparatus according to claim 6, wherein the supply power to the induction-current generation coil is turned off at a time of the temperature of the heat generating member exceeds the second reference temperature.

19. A method of controlling a fixing apparatus according to claim 16, wherein the supply power to the induction-current generation coil is continued to be on at a time of the temperature of the heat generating member is lower than the second reference temperature.

20. A method of controlling a fixing apparatus according to claim 16, wherein the supply power to the induction-current generation coil is adjusted according to a temperature difference between the first reference temperature and the temperature of the heat generating member.

21. A method of controlling a fixing apparatus according to claim 20, wherein the supply power to the induction-current generation coil is increased at a time of the temperature of the heat generating member is lower than the first reference temperature.

22. A method of controlling a fixing apparatus according to claim 20, wherein the supply power to the induction-current generation coil is reduced at a time of the temperature of the heat generating member is higher than the first reference temperature.

23. A method of controlling a fixing apparatus according to claim 16, further comprising:

setting a third reference temperature for forcibly turning off the supply power to the induction-current generation coil; and turning off the supply power to the induction-current generation coil at a time of the temperature of the heat generating member reaches the third reference temperature.

24. A method of controlling a fixing apparatus according to claim 16, wherein the second reference temperature is set to be equal to or higher than the first reference temperature.

25. A method of controlling a fixing apparatus according to claim 16, wherein, if the supply power to the induction-current generation coil is a minimum output at an adjustable limit, the second reference temperature is changed if the temperature of the heat generating member exceeds a predetermined temperature.

26. A method of controlling a fixing apparatus according to claim 25, wherein the second reference temperature is changed to be the same as the first reference temperature.

27. A method of controlling a fixing apparatus according to claim 16, further comprising, turning off the supply power immediately if the temperature of the heat generating member reaches the second reference temperature.

* * * * *